United States Patent [19]

Nakayama

[11] Patent Number: 4,688,834

[45] Date of Patent: Aug. 25, 1987

[54] LOCKING DEVICE

[75] Inventor: Hiromichi Nakayama, Yokohama, Japan

[73] Assignee: Nifco Inc., Yokohama, Japan

[21] Appl. No.: 870,166

[22] Filed: Jun. 3, 1986

[30] Foreign Application Priority Data

Aug. 5, 1985 [JP] Japan ..... 60-119256[U]

[51] Int. Cl.[4] ..... E05C 17/50

[52] U.S. Cl. ..... 292/5; 292/250; 292/64; 292/DIG. 4

[58] Field of Search ..... 292/5, 49, DIG. 4, 250, 292/64, 336

[56] References Cited

U.S. PATENT DOCUMENTS

| | | | |
|---|---|---|---|
| 836,810 | 11/1906 | Kapus | 292/DIG. 4 |
| 995,429 | 1/1911 | Carter | 292/250 |
| 1,742,306 | 1/1930 | Dombrowski | 292/250 |
| 2,586,356 | 2/1952 | Lewis | 292/DIG. 4 |
| 2,691,702 | 10/1954 | Allison | 292/DIG. 4 |
| 4,331,355 | 5/1982 | Okuno | 292/DIG. 4 |

FOREIGN PATENT DOCUMENTS

| | | | |
|---|---|---|---|
| 58-148160 | 10/1983 | Japan | 292/DIG. 4 |
| 60-11977 | 1/1985 | Japan | 292/DIG. 4 |
| 594981 | 11/1947 | United Kingdom | 292/DIG. 4 |

*Primary Examiner*—Cornelius J. Husar
*Assistant Examiner*—Eric K. Nicholson
*Attorney, Agent, or Firm*—Trexler, Bushnell, Giangiorgi & Blackstone, Ltd.

[57] ABSTRACT

A locking device has a slide accommodated in a stationary casing and spring biased in the direction causing it to project out of said stationary casing. When the slide is retracted into said stationary casing, a locking arm which is pivotally coupled to the slide is turned to a position facing the exposed end of the slide where it catches an engagement member between itself and the end of the slide. The slide can be locked in a retracted state by a cam member. When the slide is released from the locked state by the cam member, the locking arm can be brought away from the end of the slide.

4 Claims, 11 Drawing Figures

(A)

(B)

LOCKING DEVICE

FIELD OF THE INVENTION AND RELATED ART STATEMENT

This invention relates to a locking device used for locking closed a lid, door, etc. capable of opening and closing. More particularly, the invention concerns a locking device, which can be effectively utilized as a locking device for locking closed a door of a piece of furniture, a lid of an electric apparatus or a door in the dashboard of an automobile in such manner that the door or lid is locked in the closed state when it is pushed once in one direction and unlocked when it is pushed once again in the same direction.

Various locking devices for holding doors, lids and the like in a locked state have been proposed. Among these locking devices, there is one, which can be alternately put into a locked state and an unlocked state by giving successive pushes in the same direction.

When the locking device which is alternately locked and unlocked by successive pushes is used for a door or lid, it eliminates the need for a grip or handle on the door or lid surface, and the door or lid can be unlocked and opened by merely pushing the lid surface. This structure is advantageous from the point of allowing greater freedom in the design of the piece of furniture. The locking device is used in and also advantageous from the safety standpoint since it enables elimination of projections from the furniture surface.

The locking device of this push type usually has an engagement cam piece, and the projection and retraction of a slide which is slidably received in a stationary casing are controlled by the engagement of the cam piece. The slide is provided with engagement means for engaging and disengaging with its movement relative to the stationary casing for locking and unlocking an engagement member, which may be provided on the free end of a back surface of a door.

Examples of the locking device employing such engagement means are the latches disclosed in Japanese Utility Model Public Disclosure Nos. 58-148160 and 60-11977.

In these prior art locking devices, the projection and retraction of a rod (i.e. a slide) are controlled by the engagement and disengagement of a cam, and a locking member integral with the rod is put in the locked state and the unlocked state by making use of an opening in a stationary casing, in which the rod is accommodated.

With these locking devices, satisfactory control of the projection and retraction of the slide can be obtained with the cam piece. However, there are problems with the locking member which is engaged and disengaged in an interlocked relation with the operation of the cam piece. Particularly, where the locking device is used for a lid or a door for which a strong locking force is required, if the lid or door is pulled with a strong force, it will be detached from the locking member. Further, when the device is repeatedly operated with strong force, a hinge portion of the locking member is damaged so that the device can no longer be used.

OBJECT AND SUMMARY OF THE INVENTION

The invention was made to eliminate the aforesaid instability of the locking means in the locked state that is a problem in the prior art locking device, and its object is to provide a locking device which can reliably hold an engagement member in a locked state and reliably unlock the engagement member, and which has a long service life.

To attain the above object of the invention, there is provided a locking device for locking and unlocking an engagement member, which comprises a stationary casing having an open end, a slide accommodated in the stationary casing and spring biased by a compression spring toward the open end, a locking arm having shafts slidably received in grooves formed in the slide, for being projected out of and retracted into the stationary casing with movement of the slide relative to the stationary casing, and a cam member rotatably supported by the slide and having a notched portion capable of engagement with an engagement projection provided on the stationary casing, the cam member being capable of assuming a state in which the slide is locked in a retracted state and another state in which the slide can be projected out of the stationary casing.

The slide is put in the locked state to lock the engagement member with the locking arm with the notch portion of the cam member in engagement with the engagement projection when the locking arm is turned about the shafts and withdrawn into the stationary casing with the slide pushed by the engagement member for the first time in the unlocked state. The slide is brought to the unlocked state again to unlock the engagement member when the engagement of the cam member and engagement projection is released to allow projection of the slide due to the biasing force of a biasing spring along with turning of the locking arm about the shafts with the slide pushed again by the engagement member.

When the slide is pushed by the engagement member, it is retracted into the stationary casing. At this time, the locking arm, which has been in a turned-down state, is turned about the shafts to a position to lock the engagement member. At the same time, the slide is held in the retracted state by the engagement between the cam member and the stationary casing. Thus, the engagement member is held locked. When the engagement member is urged again, the cam member is rotated and disengaged from the engagement projection to allow the projection of the slide with the locking arm, which is withdrawn from the stationary casing and turned down about the shafts. Thus, the engagement member is unlocked.

The above and other objects and features of the invention will become more apparent from the following detailed description with reference to the accompanying drawings.

DETAILED DESCRIPTION OF THE PREFERRED EMBODIMENT

Figure 1:
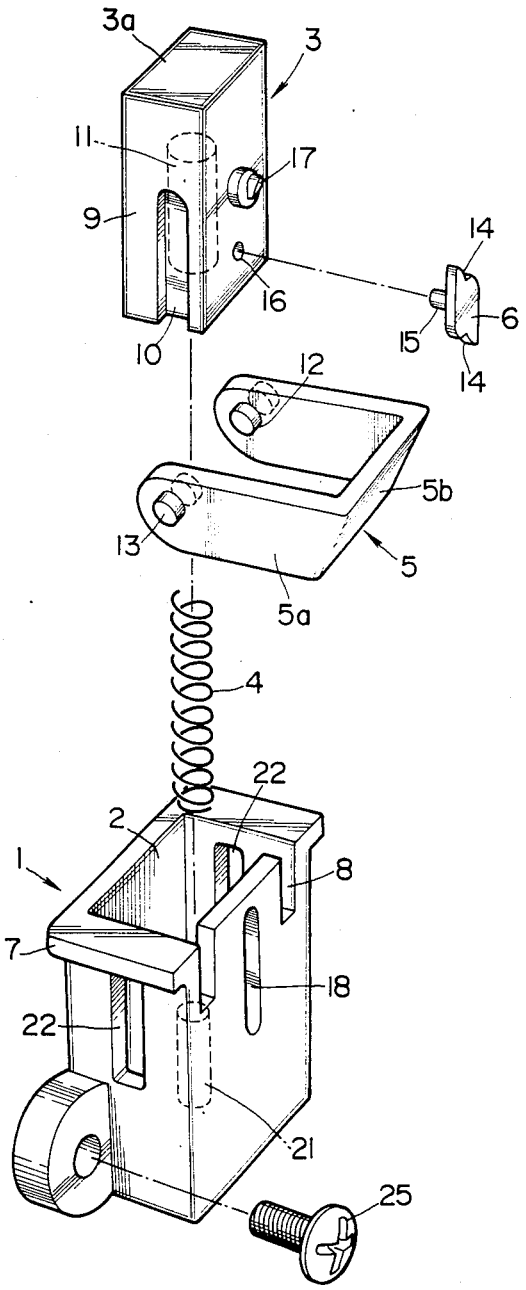
FIG. 1 is an exploded perspective view showing an embodiment of the locking device according to the invention.

An embodiment of the locking device according to the invention will now be described with reference to the drawings.

Referring to the Figures, reference numeral 1 designates a stationary casing with an opening 2 at one end, numeral 3 a slide which is accommodated in the stationary casing 1, numeral 4 a spring providing the slide 3 with biasing force toward the opening 2, numeral 5 a locking arm which can be moved into and out of the opening 2 of the casing 1 with the movement of the slide 3, and numeral 6 a cam member which can lock the slide when it is pushed into the casing and release and permit projection of the slide out of the casing when pushed once again.

The illustrated stationary casing 1 has a rectangular sectional profile. It has an outer molding flange 7 extending from three side surfaces adjacent to the opening 2. It also has a pair of longitudinal notches 8 formed in the remaining side wall near the opposite ends thereof and communicating with the opening 2.

The slide 3 has a rectangular shape and can be easily accommodated in the stationary casing 1. It has a pair of shallow grooves 10 formed on its opposite side surfaces 9 extending from the front end up to a longitudinally intermediate position. It further has a blind hole 11 extending from the front end up to a longitudinally intermediate position. The spring 4 is accommodated in the blind hole 11.

The locking arm 5 is channel-shaped and has two parallel arm portions **5*a*. The free end of each of the arm portions 5*a* is provided with a shaft 12 which extends from the inner surface and is slidably received in the corresponding groove 10 of the slide 3, and with a pin 13, which coaxially extends with the shaft 2** from the outer surface and serves as a stop.

The cam member 6 is an elongate plate-like member having a V-shaped notch 14 formed at each end. It has an integral support shaft 15 projecting from the center of one side surface. The support shaft 15 is inserted in a shaft hole 16 formed in one surface of the slide 3, whereby the cam member 6 is rotatably supported.

In the Figures, reference numeral 17 designates a stop projecting from one surface of the slide 3, numeral 18 a longitudinal guide slot which is formed in one side wall of stationary casing 1 and in which the stop 17 is slidably received, numeral 19 an engagement projection which is provided on the inner surface of the same side wall of the stationary casing and can engage with the cam member 6, and numeral 20 a projection which projects inwardly from the bottom wall of the stationary casing and serves to change the orientation of the cam member 6.

The components described above which constitute the locking device according to the invention are formed separately as shown in the exploded perspective view of FIG. 1 and are assembled together. In this embodiment, the spring 4 is fitted on a longitudinal spring retainer pin 21 projecting inwardly from the center of the bottom wall of the stationary casing 1. Then, the locking arm 5 is assembled with the shafts 12 slidably received in the grooves 10. Also, the cam member 6 is assembled by inserting the support shaft 15 into the shaft hole 16. Then, the slide 3 with the locking arm 5 and the cam member 6 is inserted into the stationary casing 1 from the opening 2 thereof.

As the slide 3 is inserted into the stationary casing 1, the spring 4 is received in the blind hole 11 and compressed by the bottom thereof. At the same time, the pins 13 are received in slots 22 formed in the corresponding opposite side walls of the stationary casing 1 by outwardly forcing these walls. Further, the stop 17 is received in the guide slot 18 formed in one wall of the stationary casing by outwardly forcing this wall. The slide 3 is thus retained in the stationary casing 1 and prevented from being pushed out of the casing by the biasing force of the compressed spring 4.

Figure 4:
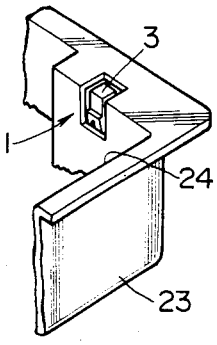
FIG. 4 is a fragmentary perspective view showing an example of use of the locking device.

FIG. 4 shows the locking device assembled in the above way for use as a locking device for closing a lid of a box. As is shown, the device is accommodated in a notch or recess provided in a box 23 adjacent to an open end 24 thereof such that the slide 3 projects outwardly, and in this state the device is secured by a bolt or the like to the box. The lid of the box (not shown) is provided at a position corresponding to the locking device with an engagement member so that the engagement member can cooperate with the slide when closing the lid.

Now, the operation of the locking device according to the invention which fulfills its function by a pushing action on an engagement member 26 will be described in detail with reference to the drawings.

Figure 2:
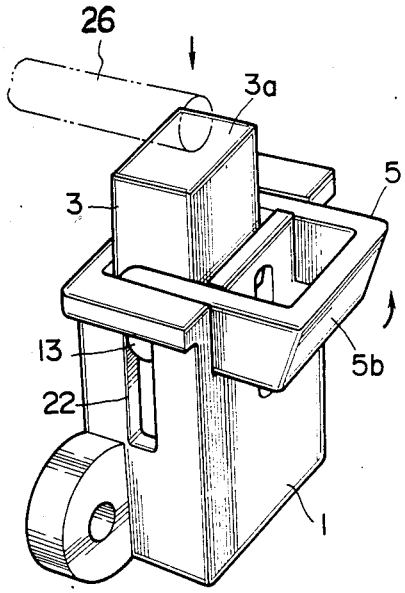
FIG. 2 is a perspective view showing the locking device in the unlocked state.
Figure 3:
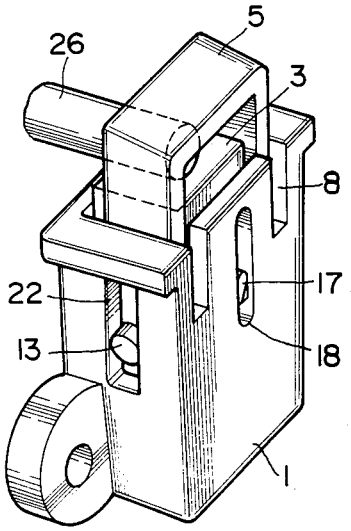
FIG. 3 is a perspective view showing the locking device in the locked state.
Figure 5:
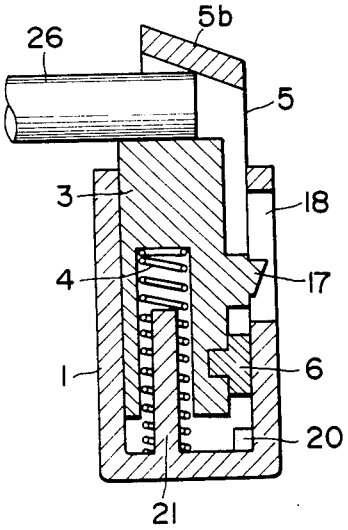
FIG. 5 is a longitudinal sectional view showing the locking device in the locked state.

FIG. 2 is a perspective view showing the locking device in the unlocked state. In this state of the device, the slide 3 projects outwardly due to the biasing force of the spring 4. The projection of the slide 3 is limited by the engagement of the stop 17 with one end of the guide slot 18. This unlocked state is brought about with the ends of the arm portions **5*a* of the locking arm having the pins 13 brought to a position in the vicinity of the open end 2 of the stationary casing. At this time, the locking arm 5 is rotated about the shafts 12 to be turned down so that the arm portions 5*a* are received in the notches 8, and a locking portion 5*b* of the locking arm is retracted from a position facing an engagement end 3*a*** of the slide.

FIGS. 6(A) and 6(B) show the locking device in this unlocked state. The engagement member 26 which is in engagement with the engagement end **3*a* of the slide can be freely separated from the engagement end. That is, the lid or door or the like which is provided with the engagement member 26** can be freely opened.

When the engagement member 26 in engagement with the engagement end **3*a* is pushed in the direction of the arrow in FIG. 6(B), the slide 3 is retracted into the stationary casing while compressing the spring 4. When the slide 3 is brought to a deepest position, the notch 14 at one end of the cam member 6, which has been held upright, comes into engagement with the projection 20, so that the cam member 6 is slightly inclined (see FIG. 7**).

When the pushing force exerted on the slide 3 is removed at this time, the notch 14 at the other end of the cam member 6 comes into engagement with the projection 19. Thus the slide 3 is locked in the retracted state.

With the retraction of the slide 3, the locking arm 5 with the shafts 12 slidably received in the grooves 10 is brought into the casing with the shafts 12 in engagement with the end of the grooves 10. At this time the locking arm 5 is rotated about the bottom of the notches 8 so that the locking portion **5*b* comes to a position facing the engagement end 3*a* of the slide, thus locking the engagement member 26**.

It will be noted that the locking device is put in the locked state when it is pushed by the engagement member 26 for the first time in the unlocked state.

Figure 8:
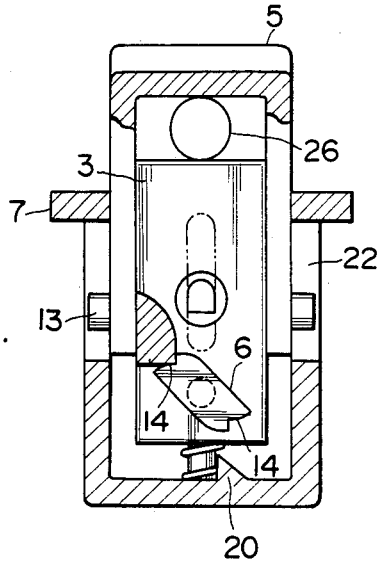
FIG. 8(A) is a front view, partly in section, showing the locking device in the locked state.
FIG. 8(B) is a side view, partly in section, showing the locking device in the locked state.
Figure 8:
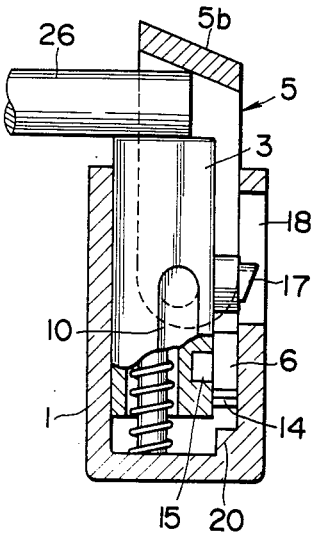
Figure 9:
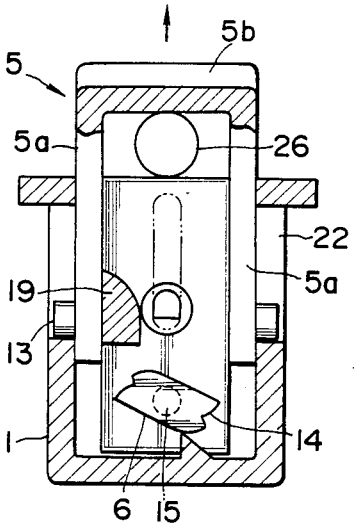
FIG. 9 is a front view, partly in section, showing the locking device with the slide pushed to the deepest position to unlock the engagement member.

FIGS. 8(A) and 8(B) show the locking device in the locked state. When the locking device in this state is pushed again by the engagement member 26, the cam member 6 which is in a slightly tilted position is further tilted in engagement with the projection 20 to a position at which it is substantially perpendicular to the direction of projection and retraction of the slide 3. By removing the pushing force in this state, the slide 3 is allowed to project since the cam member is no longer in engagement with the projection 19 (see FIG. 9).

Consequently, the locking arm 5 rises out of the stationary casing 1 together with the slide 3, and is turned down again about the shafts 12 to be received in the notches 8. The engagement member 26 is thus unlocked.

The locking portion **5*b* of the locking arm 5 has an inclined inner surface, with which an end of the engagement member 26** engages. The engagement member thus can be pushed away when it is unlocked.

Figure 6:
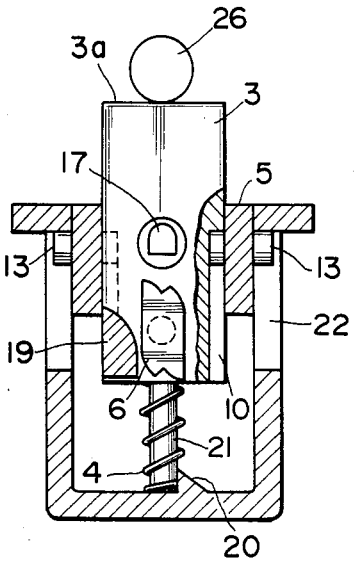
FIG. 6(A) is a front view, partly in section, showing the locking device in the unlocked state.
FIG. 6(B) is a side view, partly in section, showing the locking device in the unlocked state.
Figure 6:
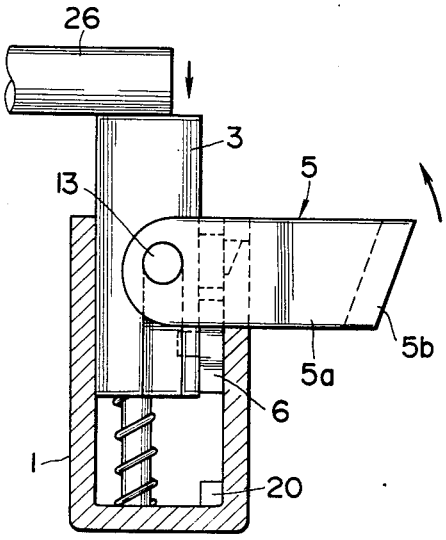
Figure 7:
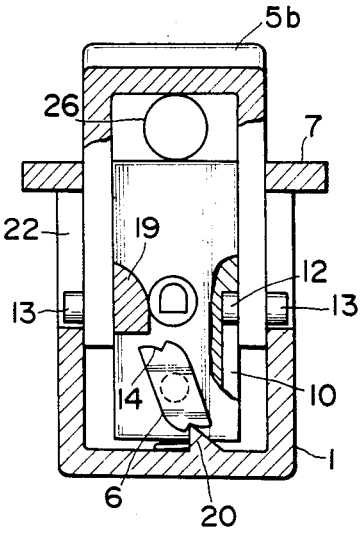
FIG. 7 is a front view, partly in section, showing the locking device with the slide retracted to the deepest position to lock an engagement member.

Once the engagement member 26 has moved part way under the force of the spring 4, the lid of the box or the like carrying the engagement member 26 is moved manually to an open position. This causes the engagement member to cam the inclined locking portion **5*b* of the locking arm to cause the latter to pivot to horizontal position with the parallel arm portions 5*a* received in the notches 8. Such pivoting further is affected by gravity and eccentricity of the locking arm 5 relative to the shafts 12 and pins 13 as best seen in FIG. 6**.

As has been described in the foregoing, the locking device according to the invention can lock the engagement member provided on the lid, door, etc. capable of being opened and closed, when it is pushed for the first time in the unlocked state by the engagement member, and unlock the engagement member when it is pushed again in the same direction in the locked state. Thus, the locking device according to the invention can be operated in the same way as the prior art locking device. In addition, no handle or grip for opening and closing the lid, door, etc. is needed. Further, when the locking device according to the invention is put in the locked state by the retraction of the slide, the locking portion of the locking arm embraces the engagement member to lock the same. Thus, the engagement member will not be released unless the slide is allowed to project with the release thereof by the cam member. It is thus possible to ensure a reliable and firm closed state.

Further, the locking arm of the locking device according to the invention is turned about the shafts slidably received in the grooves of the slide for repeatedly locking and unlocking the engagement member, so that it is safe from damage during operation. The locking device according to the invention thus has a long service life.

What is claimed is:

1. A locking device for locking and unlocking an engagement member, comprising:

a stationary casing having an open end;

a slide accommodated in said stationary casing and spring biased by a compression spring toward said open end;

a U-shaped arm having a pair of legs and an interconnecting bight and having shafts slidably received in grooves formed in said slide, said arm having an unlocked position projecting out of said stationary casing and having a locked position substantially within said casing with movement of said slide relative to said stationary casing; and a cam member rotatably supported by said slide and having a notched portion, a fixed engagement projection in said casing, said notched portion being selectively engageable with said engagement projection in said stationary casing;

said slide being held in locking position to lock said engagement member with the bight of said locking arm by engagement of said notched portion of said cam member with said engagement projection, said locking arm having pivoted about said shafts and moved into said stationary casing with said slide pushed by said engagement member from unlocked position, said slide subsequently moving to unlocked position to unlock said engagement member, engagement of said cam member with said engagement projection being released to allow movement of said arm to unlocked position being effected by biasing force of said biasing spring along with a pivoting of said locking arm about said shafts when said slide is pushed again by said engagement member.

2. The locking device according to claim 1, wherein said cam member is a substantially rectangular elongate plate member having a V-shaped notch provided at each end and having a support shaft disposed on one side surface.

3. The locking device according to claim 1, wherein said locking arm bight is an inclined cam surface between said arms inclined to a plane containing said legs.

4. The locking device according to claim 1, wherein said stationary casing has an outer wall surface and an outer flange on said outer wall surface adjacent to said open end.

* * * * *